US005765396A

United States Patent [19]

Bonaquist

[11] Patent Number: 5,765,396

[45] Date of Patent: Jun. 16, 1998

[54] CRYOGENIC RECTIFICATION SYSTEM FOR PRODUCING HIGH PRESSURE NITROGEN AND HIGH PRESSURE OXYGEN

[75] Inventor: Dante Patrick Bonaquist, Grand Island, N.Y.

[73] Assignee: Praxair Technology, Inc., Danbury, Conn.

[21] Appl. No.: 820,789

[22] Filed: Mar. 19, 1997

[51] Int. Cl.[6] ..... F25J 3/00

[52] U.S. Cl. ..... 62/646; 62/924

[58] Field of Search ..... 62/646, 924

[56] References Cited

U.S. PATENT DOCUMENTS

| | | | |
|---|---|---|---|
| 4,817,393 | 4/1989 | Erickson | 62/22 |
| 4,817,394 | 4/1989 | Erickson | 62/22 |
| 4,854,954 | 8/1989 | Erickson | 62/22 |
| 5,098,456 | 3/1992 | Dray et al. | 62/24 |
| 5,108,476 | 4/1992 | Dray et al. | 62/24 |
| 5,114,452 | 5/1992 | Dray | 62/24 |
| 5,245,832 | 9/1993 | Roberts | 62/924 |
| 5,251,449 | 10/1993 | Rottmann | 62/924 |
| 5,365,741 | 11/1994 | Roberts et al. | 62/38 |
| 5,533,339 | 7/1996 | Clare et al. | 62/654 |

*Primary Examiner*—Ronald C. Capossela
*Attorney, Agent, or Firm*—Stanley Ktorides

[57] ABSTRACT

A cryogenic rectification system for processing feed air wherein a defined large flow of high pressure nitrogen shelf vapor is recovered directly from the higher pressure column of a double column, pressurized oxygen liquid is vaporized to produce high pressure oxygen product against a portion of the feed air, and the resulting condensed feed air portion is split in a defined manner and fed into each of the higher and lower pressure columns of the double column.

9 Claims, 5 Drawing Sheets

CRYOGENIC RECTIFICATION SYSTEM FOR PRODUCING HIGH PRESSURE NITROGEN AND HIGH PRESSURE OXYGEN

TECHNICAL FIELD

This invention relates generally to the cryogenic rectification of air, and more particularly to the cryogenic rectification of air to produce both high pressure nitrogen and high pressure oxygen.

BACKGROUND ART

The cryogenic separation of mixtures such as air to produce oxygen and nitrogen is a well established industrial process. Liquid and vapor are passed in countercurrent contact through one or more columns and the difference in vapor pressure between the oxygen and nitrogen causes nitrogen to concentrate in the vapor and oxygen to concentrate in the liquid. The lower the pressure is in the separation column, the easier is the separation into oxygen and nitrogen due to vapor pressure differential. Accordingly, the final separation into product oxygen and nitrogen is generally carried out at a relatively low pressure, usually just a few pounds per square inch (psi) above atmospheric pressure.

In some situations both the product oxygen and the product nitrogen are desired at an elevated pressure. In such situations, oxygen vapor and nitrogen vapor are each compressed to the desired pressure in compressors. This compression is costly in terms of energy costs as well as capital costs for the product compressors.

Accordingly, it is an object of this invention to provide a cryogenic rectification system for producing both high pressure nitrogen and high pressure oxygen without need for product gas compression.

SUMMARY OF THE INVENTION

The above and other objects, which will become apparent to those skilled in the art upon a reading of this disclosure, are attained by the present invention, one aspect of which is:

A method for producing high pressure nitrogen and high pressure oxygen by the cryogenic rectification of feed air comprising:

(A) condensing a portion of the total feed air to produce condensed feed air, passing a first portion of the condensed feed air into a higher pressure column, and passing a second portion of the condensed feed air, comprising from 5 to 17.5 percent of the total feed air, into a lower pressure column;

(B) producing by cryogenic rectification within the higher pressure column nitrogen-enriched vapor and oxygen-enriched liquid, and recovering a portion of the nitrogen-enriched vapor, comprising at least 20 percent of the total feed air, as high pressure nitrogen;

(C) producing by cryogenic rectification within the lower pressure column nitrogen-rich vapor and oxygen-rich liquid;

(D) withdrawing oxygen-rich liquid from the lower pressure column, pressurizing the withdrawn oxygen-rich liquid to produce high pressure oxygen-rich liquid, and vaporizing the high pressure oxygen-rich liquid by indirect heat exchange with said condensing feed air to produce high pressure oxygen-rich vapor; and (E) recovering high pressure oxygen-rich vapor as high pressure oxygen.

Another aspect of the invention is:

Apparatus for producing high pressure nitrogen and high pressure oxygen by the cryogenic rectification of feed air comprising:

(A) a cryogenic rectification plant comprising a first column, a second column and a product boiler heat exchanger;

(B) means for passing feed air into the product boiler heat exchanger, means for passing feed air from the product boiler heat exchanger into the first column, and means for passing feed air, comprising from 5 to 17.5 percent of the total feed air, from the product boiler heat exchanger into the second column;

(C) means for recovering fluid from the upper portion of the first column, comprising at least 20 percent of the total feed air, as high pressure nitrogen;

(D) a liquid pump, means for passing liquid from the lower portion of the second column to the liquid pump, and means for passing liquid from the liquid pump to the product boiler heat exchanger; and (E) means for recovering fluid from the product boiler heat exchanger as high pressure oxygen.

As used herein the term "feed air" means a mixture comprising primarily oxygen, nitrogen and argon, such as ambient air.

As used herein the term "total feed air" means all of the feed air passed into the system which undergoes cryogenic rectification.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "top condenser" means a heat exchange device that generates column downflow liquid from column vapor.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "argon column" means a column which processes a feed comprising argon and produces a product having an argon concentration which exceeds that of the feed.

DETAILED DESCRIPTION

The invention comprises the discovery that the minimum separation energy for producing oxygen in a cryogenic rectification plant will occur when the driving force within the cryogenic rectification system is reduced to the point where the oxygen recovery becomes sensitive to a further reduction in that driving force, and that this occurs at or below an oxygen recovery of about 98 percent. High pressure nitrogen is withdrawn from the higher pressure column and recovered and this coincides with an oxygen recovery of about 97 percent. Moreover, the optimal distribution of liquid feed air between the higher and lower pressure columns minimizes the oxygen separation energy by maximizing the amount of shelf vapor, i.e. high pressure nitrogen, available at a particular value of oxygen recovery. The liquid feed air is generated by vaporizing pressurized oxygen product, and the optimal distribution of the liquid feed air directed to minimizing the oxygen separation energy also is the same distribution that maximizes argon recovery.

Figure 1:
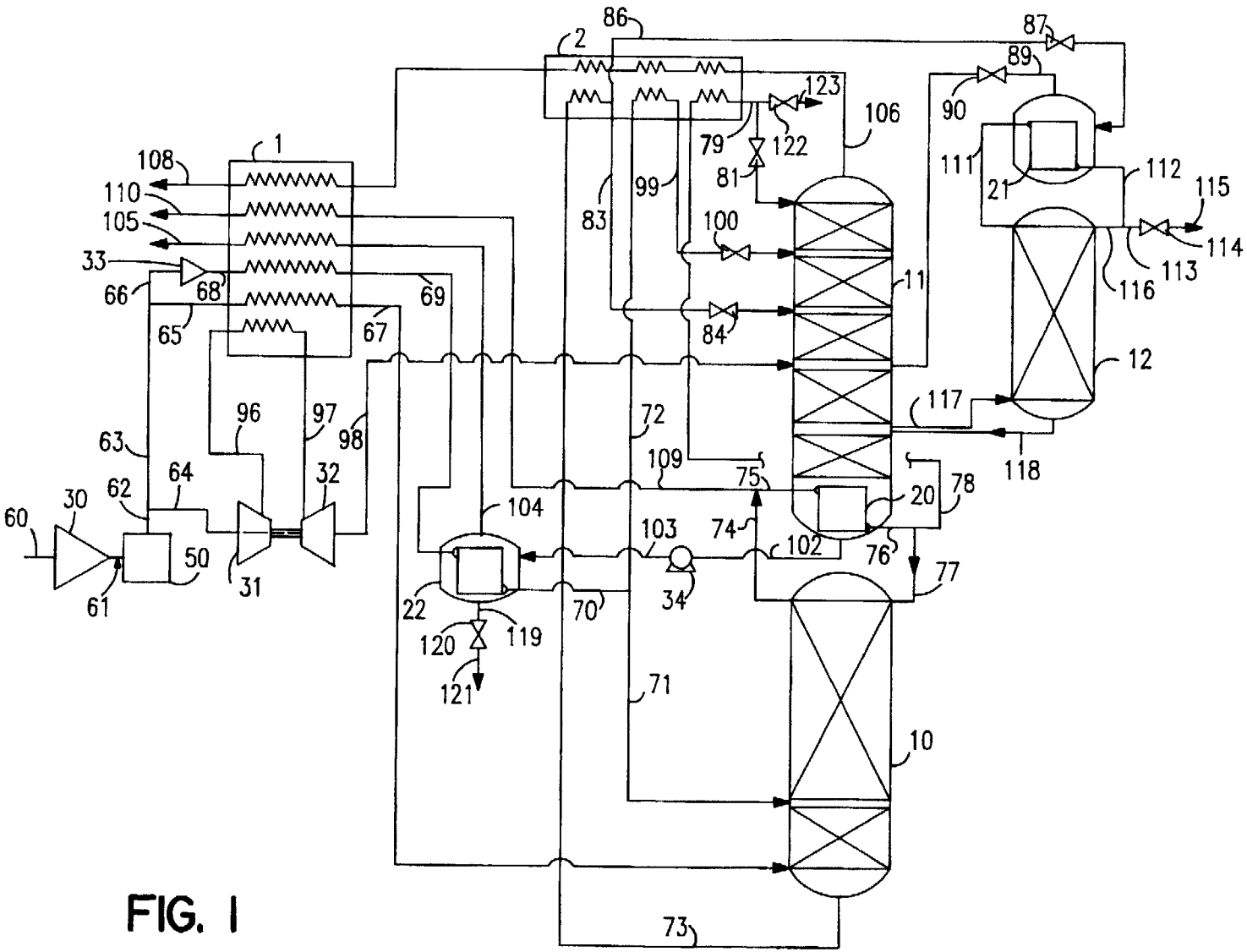
FIG. 1 is a schematic representation of one preferred embodiment of the invention.

The invention will be discussed in greater detail with reference to the Drawings. Referring now to FIG. 1, feed air 60, which is the total feed air of the system of this invention, is compressed by passage through base load compressor 30 to a pressure generally within the range of from 80 to 250 pounds per square inch absolute (psia) and then the compressed feed air 61 is cleaned of high boiling impurities, such as carbon dioxide, water vapor and hydrocarbons, by passage through prepurifier 50. Cleaned, compressed feed air 62 is divided into feed air stream 64 and feed air stream 63. Stream 64 is boosted in pressure by passage through booster compressor 31 which is direct coupled to turboexpander 32. The discharge 96 of compressor 31 is passed partially through primary heat exchanger 1 wherein it is cooled by indirect heat exchange with return streams. The resulting cooled feed air is passed from primary heat exchanger 1 in stream 97 to turboexpander 32 wherein it is turboexpanded to generate refrigeration. Resulting turboexpanded feed air stream 98 is then passed from turboexpander 32 into second or lower pressure column 11.

Feed air stream 63 is split into stream 65 and stream 66. Stream 65 is cooled by passage through primary heat exchanger 1 and resulting cooled feed air stream 67 is passed into first or higher pressure column 10, which is the higher pressure column of a double column and is operating at a pressure generally within the range of from 75 to 100 psia. Stream 66 is compressed to a pressure generally within the range of from 100 to 600 psia by passage through booster compressor 33 and the resulting pressurized feed air 68 is cooled by passage through primary heat exchanger 1 and subsequently condensed in a product boiler heat exchanger by indirect heat exchange with pressurized liquid oxygen to produce condensed feed air. The condensed feed air comprises from about 15 to 40 percent of total feed air 60 on a molar basis.

In the embodiment of the invention illustrated in FIG. 1, pressurized feed air 68 is cooled by passage through primary heat exchanger 1 and the resulting cooled feed air is passed in stream 69 to product boiler 22 wherein it is condensed. Resulting condensed feed air 70 is divided into first fraction 71 and second fraction 72. First fraction 71, which comprises from 25 to 75 percent of condensed feed air 70, is passed into higher pressure column 10. Second fraction 72, which comprises from 25 to 75 percent of condensed feed air stream 70, is subcooled by partial traverse of superheater 2 and resulting subcooled feed air stream 99 is passed through valve 100 and into lower pressure column 11 at a level from 5 to 15 equilibrium stages below the top of column 11. Second fraction 72 comprises from 5 to 17.5 percent, preferably from 7.5 to 15 percent, most preferably from 10 to 12.5 percent of the total feed air.

Within higher pressure column 10 the feed air is separated by cryogenic rectification into nitrogen-enriched vapor and oxygen-enriched liquid. Nitrogen-enriched vapor is withdrawn from the upper portion of higher pressure column 10 as stream 74 and divided into portion 109 and portion 75. Portion 109 is warmed by passage through primary heat exchanger 1 and recovered as product high pressure nitrogen 110 at a pressure generally within the range of from 75 to 99 psia and having a nitrogen concentration of at least 98 mole percent. The product high pressure nitrogen comprises at least 20 percent, and preferably from about 20 to 35 percent, of the incoming total feed air stream 60 on a molar basis. Nitrogen-enriched vapor portion 75 is passed into main condenser 20 wherein it is condensed by indirect heat exchange with lower pressure column 11 bottom liquid. Resulting nitrogen-enriched liquid 76 is divided into portion 77, which is returned to higher pressure column 10 as reflux, and into portion 78 which is subcooled by partial traverse of superheater 2. Resulting subcooled stream 79 is passed through valve 81 and into lower pressure column 11. If desired, a portion 123 of stream 79 may be passed through valve 122 and recovered as high pressure liquid nitrogen.

Oxygen-enriched liquid, having an oxygen concentration generally within the range of from 25 to 45 mole percent, is withdrawn from the lower portion of higher pressure column 10 as stream 73, subcooled by partial traverse of superheater 2, and divided into first portion 83 and second portion 86. First portion 83 is passed through valve 84 and into lower pressure column 11. Second portion 86 is passed through valve 87 and into argon column top condenser 21 wherein it is essentially completely vaporized. Resulting oxygen-enriched vapor is passed in stream 89 from top condenser 21 through valve 90 and into lower pressure column 11 at a level from 1 to 10 equilibrium stages below the point where stream 83 is passed into lower pressure column 11. Those skilled in the art will recognize that a small liquid drain, amounting to no more than 0.3 percent of the oxygen-enriched liquid passed into the argon column top condenser, may be withdrawn from the bottom of this top condenser for safety purposes.

Second or lower pressure column 11 is the lower pressure column of a double column which also comprises higher pressure column 10, and is operating at a pressure less than that of higher pressure column 10 and generally within the range of from 16 to 24 psia. Within lower pressure column 11 the various feeds into the column are separated by cryogenic rectification into nitrogen-rich vapor and oxygen-rich liquid. Nitrogen-rich vapor is withdrawn from the upper portion of lower pressure column 11 as stream 106, warmed by passage through superheater 2 and primary heat exchanger 1, and withdrawn from the system in stream 108 which may be recovered as low pressure gaseous nitrogen having a nitrogen concentration of at least 98 mole percent.

Oxygen-rich liquid is withdrawn from the lower portion of lower pressure column 11 in stream 102 and is pressurized to produce high pressure oxygen-rich liquid having a pressure generally within the range of from 25 to 500 psia. In the embodiment of the invention illustrated in FIG. 1, the pressurization is attained by passing stream 102 through liquid pump 34 to produce high pressure oxygen-rich liquid stream 103. Stream 103 is passed into product boiler 22 wherein it is at least partially vaporized by indirect heat exchange with the aforesaid condensing feed air. If desired, some oxygen-rich liquid may be withdrawn from product boiler 22 in stream 119, passed through valve 120 and recovered as liquid oxygen product 121. Vaporized oxygen-rich fluid is withdrawn from product boiler 22 in stream 104, warmed by passage through primary heat exchanger 1, and recovered as high pressure oxygen product 105 at a pressure generally within the range of from 25 to 500 psia and having an oxygen concentration generally within the range of from 98 to 100 mole percent.

A stream comprising primarily oxygen and argon is passed in stream 117 from lower pressure column 11 into argon column 12 wherein it is separated by cryogenic rectification into argon-richer vapor and oxygen-richer liquid. Oxygen-richer liquid is passed from argon column 12 into lower pressure column 11 in stream 118. Argon-richer vapor is passed in stream 111 into top condenser 21 wherein it is condensed by indirect heat exchange with the aforesaid vaporizing oxygen-enriched liquid. Resulting argon-richer liquid is passed out of top condenser 21 in stream 112. A portion 116 of stream 112 is passed into argon column 12 as reflux. Another portion 113 of stream 112 is passed through valve 114 and recovered as crude argon product 115 having an argon concentration generally within the range of from 90 to 99 percent.

Figure 4:
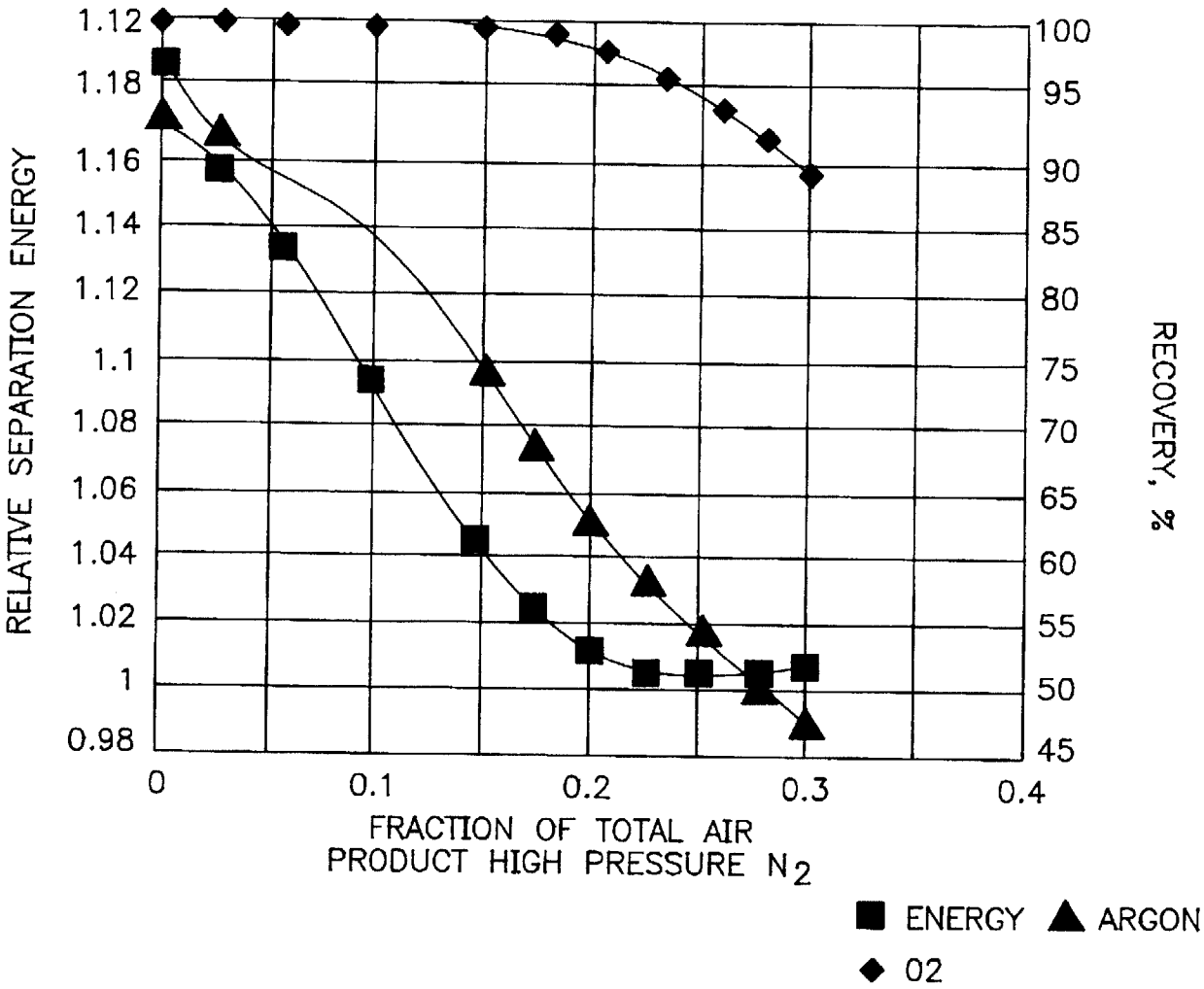
FIG. 4 is a graphical representation of the advantages of the defined preferred product high pressure nitrogen fraction of the invention.

FIG. 4 shows the relationship of the relative separation energy for oxygen with the fraction of total feed air that is recovered as high pressure nitrogen product. The relative separation energy for the production of oxygen reaches a low level when the fraction of product high pressure nitrogen reaches about 20 percent and remains at this low level as the high pressure nitrogen product fraction exceeds 20 percent. The oxygen recovery drops only to about 97 percent by the time the low energy level occurs. Argon recovery is also shown.

Figure 5:
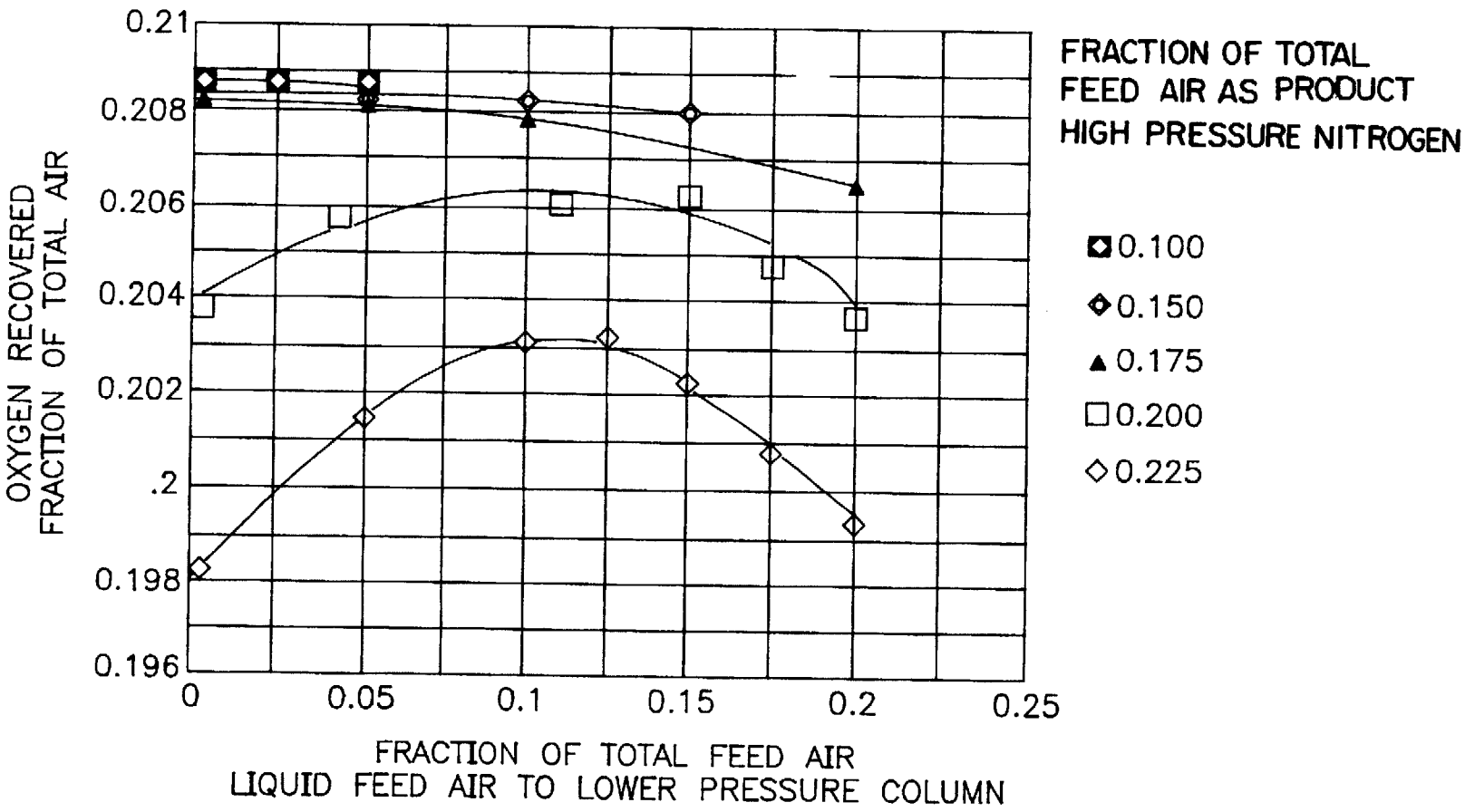
FIG. 5 is a graphical representation of the advantages of the defined liquid air distribution of the invention.

FIG. 5 gives the optimization of the split of liquid feed air between the higher pressure and lower pressure columns. FIG. 5 demonstrates that when the high pressue nitrogen product fraction is at least 20 percent of the feed air, the oxygen recovery peaks at the defined liquid air distribution to the lower pressure column of this invention. This does not happen at high pressure nitrogen product fractions less than 20 percent of the feed air. Indeed, at a high pressure nitrogen product recoveries less than 20 percent of the feed air, it is more advantageous to minimize or even eliminate the liquid air flow to the lower pressure column.

Figure 2:
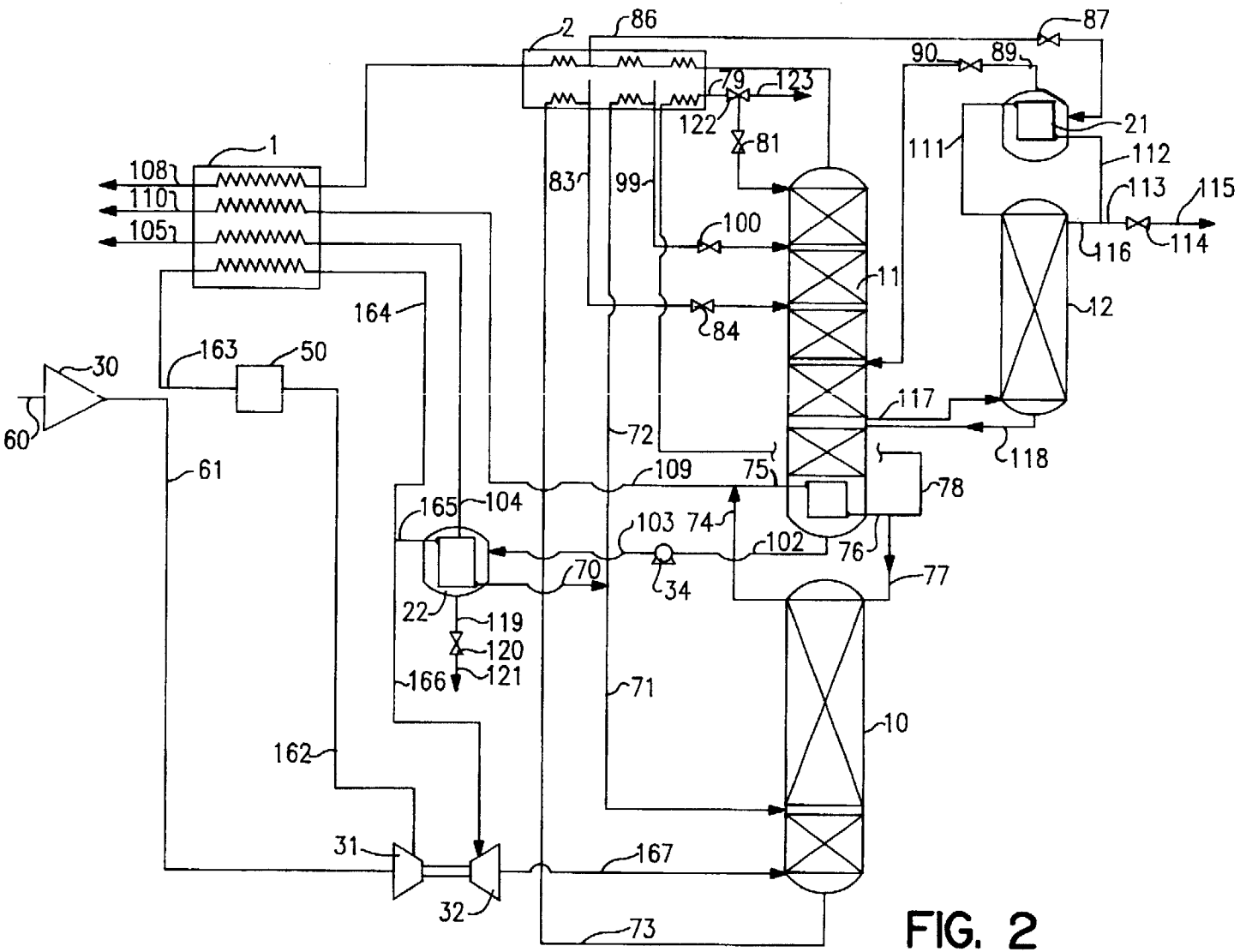
FIG. 2 is a schematic representation of another preferred embodiment of the invention.
Figure 3:
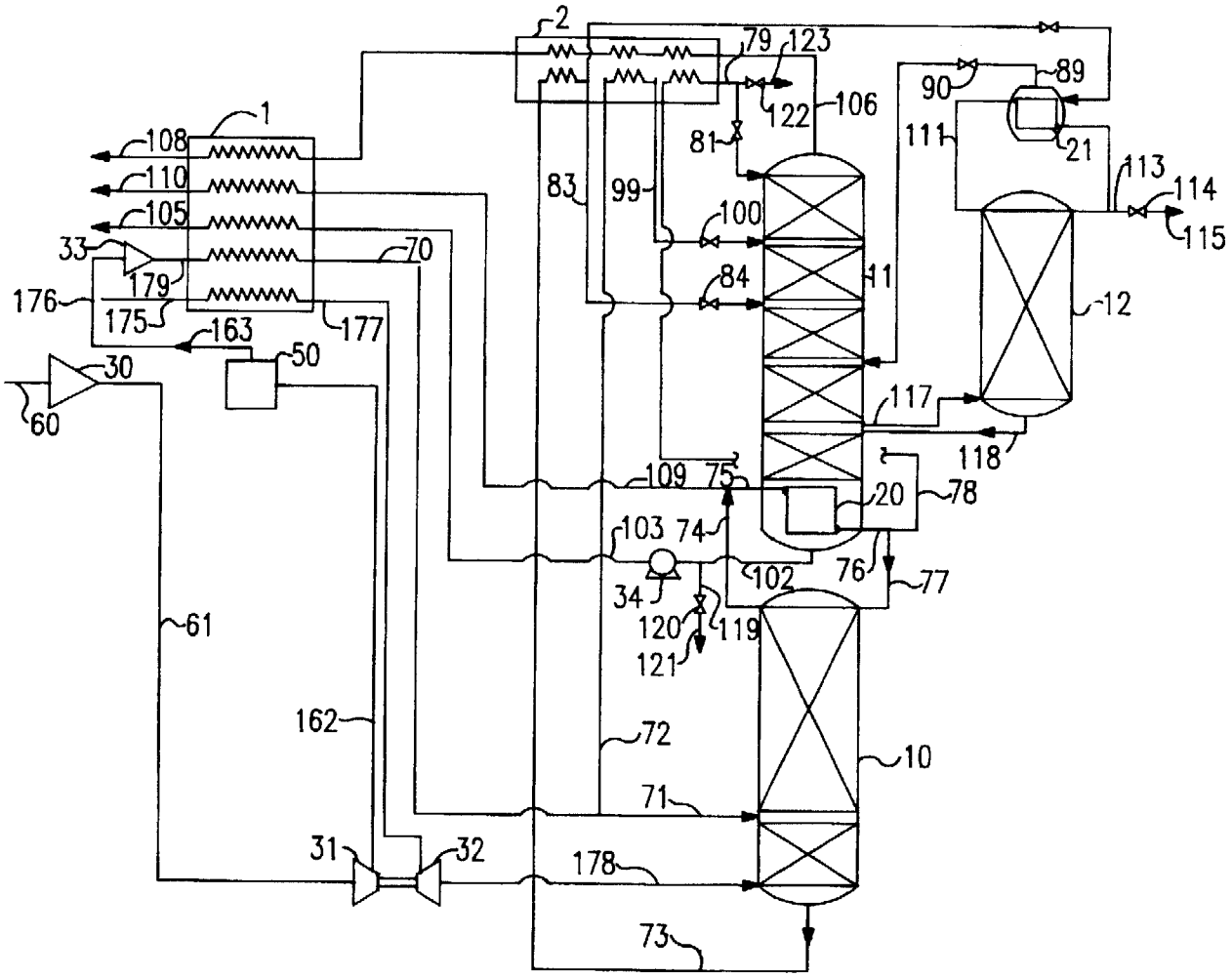
FIG. 3 is a schematic representation of yet another preferred embodiment of the invention.

FIGS. 2 and 3 each illustrate alternative preferred embodiments of the invention. The numerals in the Figures are the same for the common elements and these common elements will not be described in detail a second time.

In the embodiment illustrated in FIG. 2, compressed feed air 61 is first passed to booster compressor 31 and resulting compressed feed air stream 162 is passed through prepurifier 50. Resulting feed air stream 163 is cooled by passage through primary heat exchanger 1 and the resulting cooled feed air stream 164 is divided into first portion 165, which is condensed in product boiler 22 as previously described in conjunction with the embodiment illustrated in FIG. 1, and into second portion 166 which is turboexpanded by passage through turboexpander 32 to generate refrigeration and then passed as stream 167 into higher pressure column 10.

In the embodiment illustrated in FIG. 3 the product boiler heat exchanger is a part of the primary heat exchanger rather than being a separate product boiler as in the embodiments illustrated in FIGS. 1 and 2. Referring now to FIG. 3, feed air stream 163 is divided into first portion 175 and second portion 176. First portion 175 is cooled by passage through primary heat exchanger 1 and resulting cooled feed air stream 177 is turboexpanded by passage through turboexpander 32 to generate refrigeration and then passed as stream 178 into higher pressure column 10. Second portion 176 is increased in pressure by passage thorough compressor 32 and resulting compressed stream 179 is condensed by passage through primary heat exchanger 1 against vaporizing pressurized oxygen-rich liquid to produce condensed feed air stream 70 which is further processed as previously described. Liquid oxygen product 121, if desired, is recovered from stream 102 upstream of liquid pump 34, and pressurized oxygen-rich liquid 103 is passed thorough primary heat exchanger 1 wherein it is vaporized to produce high pressure oxygen product 105.

Now by the use of this invention one can efficiently produce both oxygen and nitrogen, both at high pressure, by the cryogenic rectification of feed air without need for product gas compression. Although the invention has been described in detail with reference to certain preferred embodiments, those skilled in the art will recognize that there are other embodiments of the invention with the spirit and the scope of the claims.

I claim:

1. A method for producing high pressure nitrogen and high pressure oxygen by the cryogenic rectification of feed air comprising:

(A) condensing a portion of the total feed air to produce condensed feed air, passing a first portion of the condensed feed air into a higher pressure column, and passing a second portion of the condensed feed air, comprising from 5 to 17.5 percent of the total feed air, into a lower pressure column;

(B) producing by cryogenic rectification within the higher pressure column nitrogen-enriched vapor and oxygen-enriched liquid, and recovering a portion of the nitrogen-enriched vapor, comprising at least 20 percent of the total feed air, as high pressure nitrogen;

(C) producing by cryogenic rectification within the lower pressure column nitrogen-rich vapor and oxygen-rich liquid;

(D) withdrawing oxygen-rich liquid from the lower pressure column, pressurizing the withdrawn oxygen-rich liquid to produce high pressure oxygen-rich liquid, and vaporizing the high pressure oxygen-rich liquid by indirect heat exchange with said condensing feed air to produce high pressure oxygen-rich vapor; and (E) recovering high pressure oxygen-rich vapor as high pressure oxygen.

2. The method of claim 1 wherein the recovered high pressure nitrogen comprises from 20 to 35 percent of the total feed air.

3. The method of claim 1 wherein the condensed feed air comprises from 15 to 40 percent of the total feed air.

4. The method of claim 1 wherein the first portion of the condensed feed air comprises from 25 to 75 percent of the condensed feed air, and the second portion of the condensed feed air comprises from 25 to 75 percent of the condensed feed air.

5. The method of claim 1 further comprising withdrawing oxygen-enriched liquid from the higher pressure column, subcooling the withdrawn oxygen-enriched liquid, dividing the subcooled oxygen-enriched liquid into a first portion and a second portion, passing the first portion of the subcooled oxygen-enriched liquid into the lower pressure column, vaporizing the second portion of the subcooled oxygen-enriched liquid to produce oxygen-enriched vapor, and passing the oxygen-enriched vapor into the lower pressure column at a level from 1 to 10 equilibrium stages below where the first portion of the subcooled oxygen-enriched liquid is passed into the lower pressure column.

6. Apparatus for producing high pressure nitrogen and high pressure oxygen by the cryogenic rectification of feed air comprising:

(A) a cryogenic rectification plant comprising a first column, a second column and a product boiler heat exchanger;

(B) means for passing feed air into the product boiler heat exchanger, means for passing feed air from the product boiler heat exchanger into the first column, and means for passing feed air, comprising from 5 to 17.5 percent of the total feed air, from the product boiler heat exchanger into the second column;

(C) means for recovering fluid from the upper portion of the first column, comprising at least 20 percent of the total feed air as high pressure nitrogen;

(D) a liquid pump, means for passing liquid from the lower portion of the second column to the liquid pump, and means for passing liquid from the liquid pump to the product boiler heat exchanger; and (E) means for recovering fluid from the product boiler heat exchanger as high pressure oxygen.

7. The apparatus of claim 6 further comprising a turboexpander, means for passing feed air to the turboexpander, and means for passing feed air from the turboexpander into the second column.

8. The apparatus of claim 6 further comprising a turboexpander, means for passing feed air to the turboexpander, and means for passing feed air from the turboexpander into the first column.

9. The apparatus of claim 6 further comprising a superheater and an argon column having a top condenser, means for passing fluid from the lower portion of the first column to the superheater, means for passing a first portion of said fluid from the superheater into the second column, means for passing a second portion of said fluid from the superheater to the top condenser, and means for passing said second portion from the top condenser into the second column at a level from 1 to 10 equilibrium stages below where said first portion is passed into the second column.

* * * * *